US006475116B2

(12) United States Patent
Chen Wu

(10) Patent No.: US 6,475,116 B2
(45) Date of Patent: Nov. 5, 2002

(54) ADJUSTABLE GRID

(75) Inventor: Chun-Yueh Chen Wu, Taichung (TW)

(73) Assignee: T. C. Chen Enterprises Co., Ltd., Taichung (TW)

( * ) Notice: Subject to any disclaimer, the term of this patent is extended or adjusted under 35 U.S.C. 154(b) by 0 days.

(21) Appl. No.: 09/900,825

(22) Filed: Jul. 9, 2001

(65) Prior Publication Data

US 2002/0115534 A1 Aug. 22, 2002

(30) Foreign Application Priority Data

Feb. 20, 2001 (TW) ..... 90202541 U

(51) Int. Cl.[7] ..... A63B 5/00; A63B 5/16; A63B 5/02; A63K 3/04

(52) U.S. Cl. ..... 482/15; 482/14; 482/17

(58) Field of Search ..... 482/14–17, 19; 446/475; 239/279, 289

(56) References Cited

U.S. PATENT DOCUMENTS

| | | | | | |
|---|---|---|---|---|---|
| 2,191,253 A | * | 2/1940 | Hanke | 482/15 |
| 2,206,501 A | * | 7/1940 | Gill | 482/15 |
| 2,706,631 A | * | 4/1955 | Holmes | 482/15 |
| 3,514,062 A | * | 5/1970 | Gordon | 248/248 |
| 4,696,470 A | * | 9/1987 | Fenner | 272/144 |
| 4,749,187 A | * | 6/1988 | Dellinger | 272/103 |
| 5,152,727 A | * | 10/1992 | Moore et al. | 482/15 |
| 5,334,121 A | * | 8/1994 | McPhilomy | 482/17 |
| 6,063,005 A | * | 5/2000 | Schwartz | 482/16 |

FOREIGN PATENT DOCUMENTS

| | | | | |
|---|---|---|---|---|
| DE | 117457 | * | 2/1901 | 482/17 |
| DE | 4322756 | * | 1/1995 | 482/15 |

OTHER PUBLICATIONS

Fred Medart Catalogue,1919, Gymnasium Apparatus.*

* cited by examiner

*Primary Examiner*—Michael A. Brown
*Assistant Examiner*—Lori Baker Amerson
(74) *Attorney, Agent, or Firm*—Rosenberg, Klein & Lee

(57) ABSTRACT

An adjustable grid having a base with a predetermined width is disclosed. Two ends of the base has a respective fixing portion; each fixing portion having a through hole for being passed through by a rope. Each fixing portion having a clamping device for fixing the rope. By the pulling force of the rope, the base can be installed steadily. The base is pivotally installed with an adjustable grid. A positioning device is installed between the base and the grid for positioning the grid as the grid stands uprightly. Therefore, the users may stumble over the grid and the grid can fall down as it is collided.

3 Claims, 8 Drawing Sheets

ADJUSTABLE GRID

FIELD OF THE INVENTION

The present invention relates to a grid, and especially to a grid having a fixing seat for being passed through by a rope. The grid is pivotally installed to a base so that the base can be installed steadily. As the grid is collided, it will fall down by nature, thereby, it being used safely and conveniently.

BACKGROUND OF THE INVENTION

In general, the training of hurdling, the runway is disposed with a plurality of grids for being stumbled by the runners. However, in general, the grids are not suitable to a younger. Especially, for new young contestants, it is difficult to continuously stumble over the grids.

Moreover, the current grids are disposed independently and thus wider frames are necessary for steadily installing a grid to stand uprightly However, a wide frame will cause a grid to be difficult to fall down as it is collided. As a result, the runner that collides the grid will fall down and is hurt. Therefore, the prior art design is not an ideal one, and thus it is necessary to have a novel design which may improve the defects in the prior art.

SUMMARY OF THE INVENTION

Accordingly, the primary object of the present invention is to provide an adjustable grid having a base with a predetermined width, wherein each of two ends of the base has a respective fixing portion, each fixing portion having a through hole for being passed through by a rope. Each fixing portion has a clamping device for fixing the rope. By the pulling force of the rope, the base can be installed steadily. The base is pivotally installed with an adjustable grid. A positioning device is installed between the base and the grid for positioning the grid as the grid stands uprightly. Therefore, the users may stumble over the grid and the grid may fall down as it is collided.

Another object of the present invention is to provide an adjustable grid, wherein the fixing portion has a clamping device for fixing the rope, thereby, the respective position between the base and the rope being adjustable. Further, the distance between two bases is adjustable. The joint portion of the grid is moveable in the stand tube for adjusting the elevation of the grid for matching the requirements of users.

The various objects and advantages of the present invention will be more readily understood from the following detailed description when read in conjunction with the appended drawing.

DETAILED DESCRIPTION OF THE PREFERRED EMBODIMENTS

Figure 1:
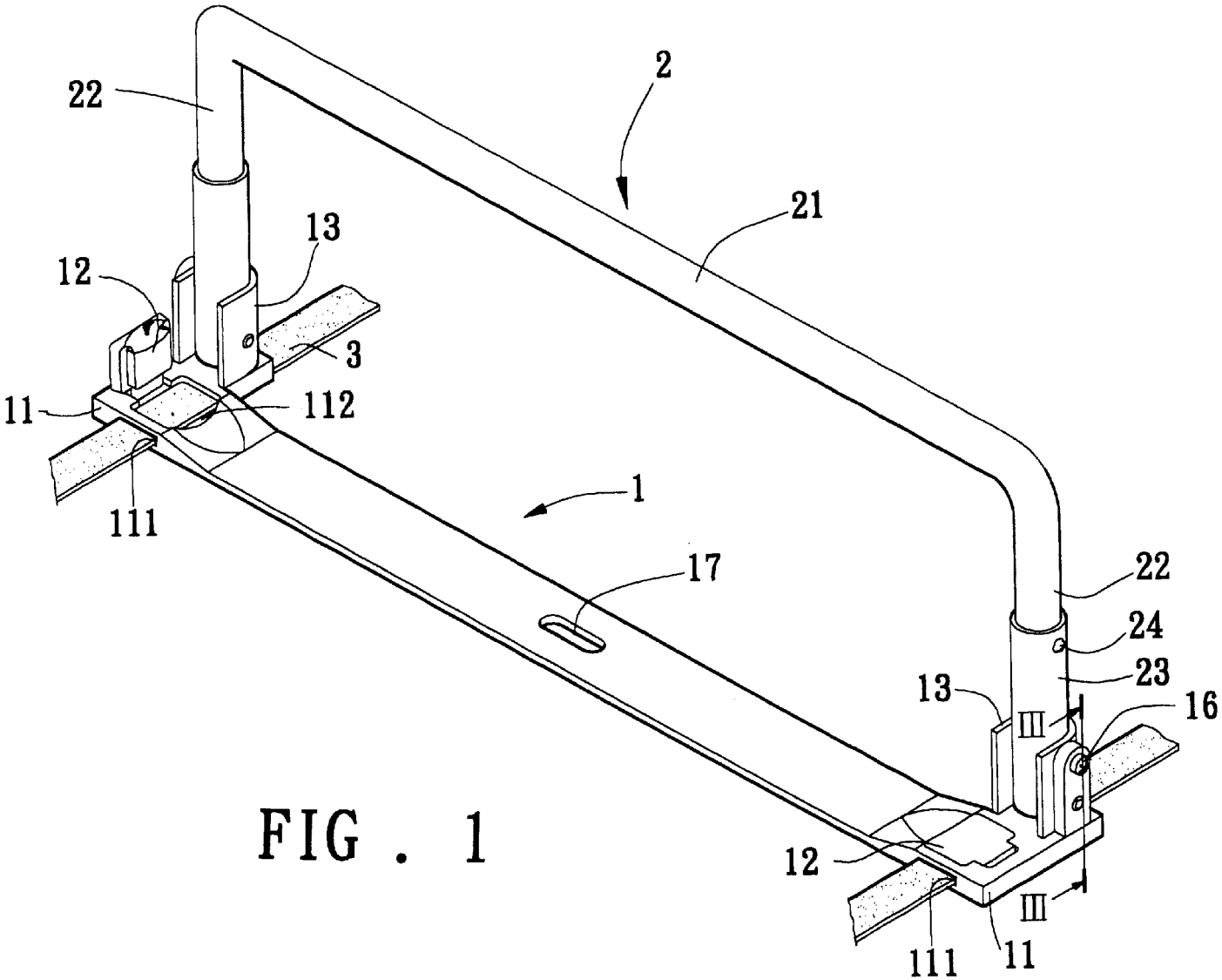
FIG. 1 is a perspective view of the present invention.
Figure 2:
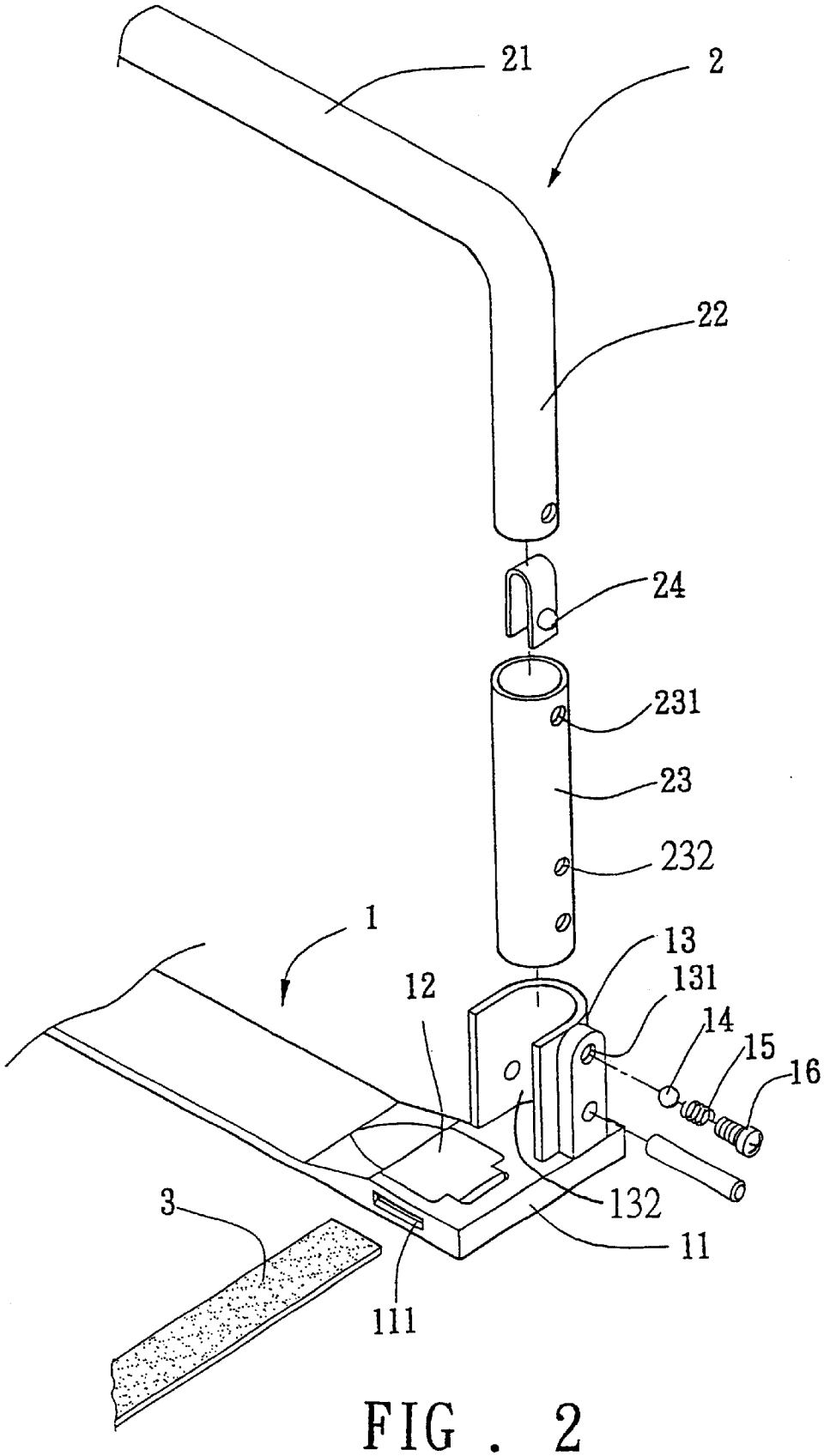
FIG. 2 is an exploded perspective view of the present invention.
Figure 3:
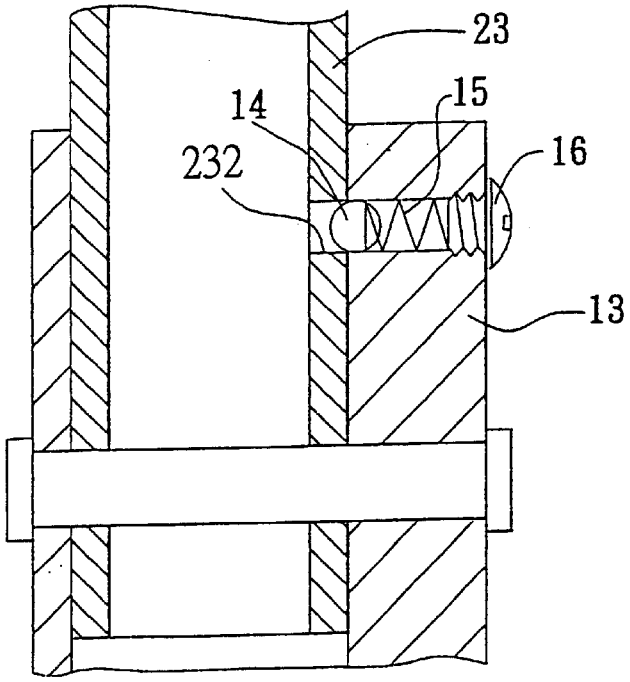
FIG. 3 is a cross sectional view along line III—III of FIG. 1.
Figure 4:
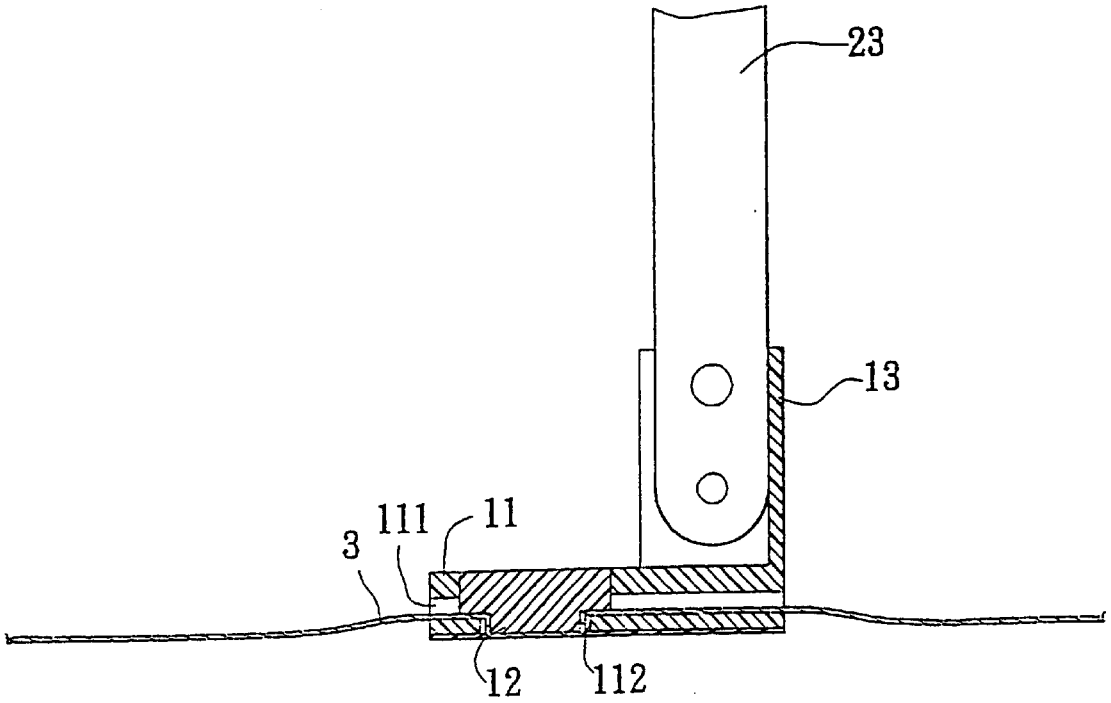
FIG. 4 is a cross sectional view along IV—IV of FIG. 1.

Referring to FIGS. 1 to 4, an adjustable grid of the present invention is illustrated. The adjustable grid includes a base 1 with a preset width. Two ends of the base 1 have a respective fixing portion 11, Each fixing portion 11 has a through hole 111 for being passed through by a rope 3. Each fixing portion 11 has a coupling block 12. As the coupling block 12 is pressed and then embedded into a concave portion 112 of the fixing potion 11, the rope 3 is clamped. Each fixing portion 11 has a pivotal scat 13. The two pivotal seats 13 may pivotally install a grid 2 for adjusting the elevation thereof. The grid 2 has a body 21. Two ends of the body 21 are bent to form a respective joint portion 22. Each joint portion 22 is engaged with a stand tube 23. The joint portion 22 is movable in the stand tube 23. One section of the joint portion 22 is engaged with the stand tube 23 and installed with a buckle 24. Each buckle 24 protrudes out of the joint portion 22. The stand tubes 23 have two buckling holes 231 arranged with respect to the buckles 24. Thereby, the buckles 24 may be buckled into the two buckling holes 231 so as to respectively joint and position the joint portions 22 with the stand tubes 23. The two stand tubes 23 are pivotally installed into the pivotal seats 13 at an end thereof. Each of the pivotal seats 13 is formed with a hole 131. A steel ball 14 and a spring 15 are sequentially installed in the hole 131. A stud 16 serves to fix the two, Thereby, the positioning steel ball 14 protrudes from the pivotal seat 13, As the stand tube 23 stands uprightly, a positioning hole 232 is formed at a position corresponding to the steel ball 14. Thereby, the positioning steel ball 14 may be embedded into the positioning hole 232 for positioning the stand tube 23. The pivotal seat 13 has an opening 132 at a position with respect to the falling down position of the stand tube 23, thereby, the stand tube 23 can fall down as it is displaced relative to the pivotal seat 13, through the opening 132. Besides, a middle section of the base 1 has a penetrating hole 17. A strip 4 can pass through the penetrating hole 17 for tightening a plurality of bases 1.

Referring to FIGS. 1 to 4, an adjustable grid of the present invention is illustrated. The adjustable grid includes a base 1 with a preset width. Two ends of the base 1 have a respective fixing portion 11, Each fixing portion 11 has a through hole 111 for being passed through by a rope 3. Each fixing portion 11 has a coupling block 12. As the coupling block 12 is pressed and then embedded into a concave portion 112 of the fixing potion 11, the rope 3 is clamped. Each fixing portion 11 has a pivotal scat 13. The two pivotal seats 13 may pivotally install a grid 2 for adjusting the elevation thereof. The grid 2 has a body 21. Two ends of the body 21 are bent to form a respective joint portion 22. Each joint portion 22 is engaged with a stand tube 23. The joint portion 22 is movable in the stand tube 23. One section of the joint portion 22 is engaged with the stand tube 23 and installed with a buckle 24. Each buckle 24 protrudes out of the joint portion 22. The stand tubes 23 have two buckling holes 231 arranged with respect to the buckles 24. Thereby, the buckles 24 may be buckled into the two buckling holes 231 so as to respectively joint and position the joint portions 22 with the stand tubes 23. The two stand tubes 23 are pivotally installed into the pivotal seats 13 at an end thereof. Each of the pivotal seats 13 is formed with a hole 131. A steel ball 14 and a spring 15 are sequentially installed in the hole 131. A stud 16 serves to fix the two, Thereby, the positioning steel ball 14 protrudes from the pivotal seat 13, As the stand tube 23 stands uprightly, a positioning hole 232 is formed at a position corresponding to the steel ball 14. rhereby, the positioning steel ball 14 may be embedded into the positioning hole 232 for positioning the stand tube 23. The pivotal seat 13 has an opening 132 at a position with respect to the falling down position of the stand tube 23, thereby, the stand tube 23 can fall down as it is displaced relative to the pivotal seat 13, through the opening 132. Besides, a middle section of the base 1 has a penetrating hole 17. A strip 4 can pass through the penetrating hole 17 for tightening a plurality of bases 1.

Figure 5:
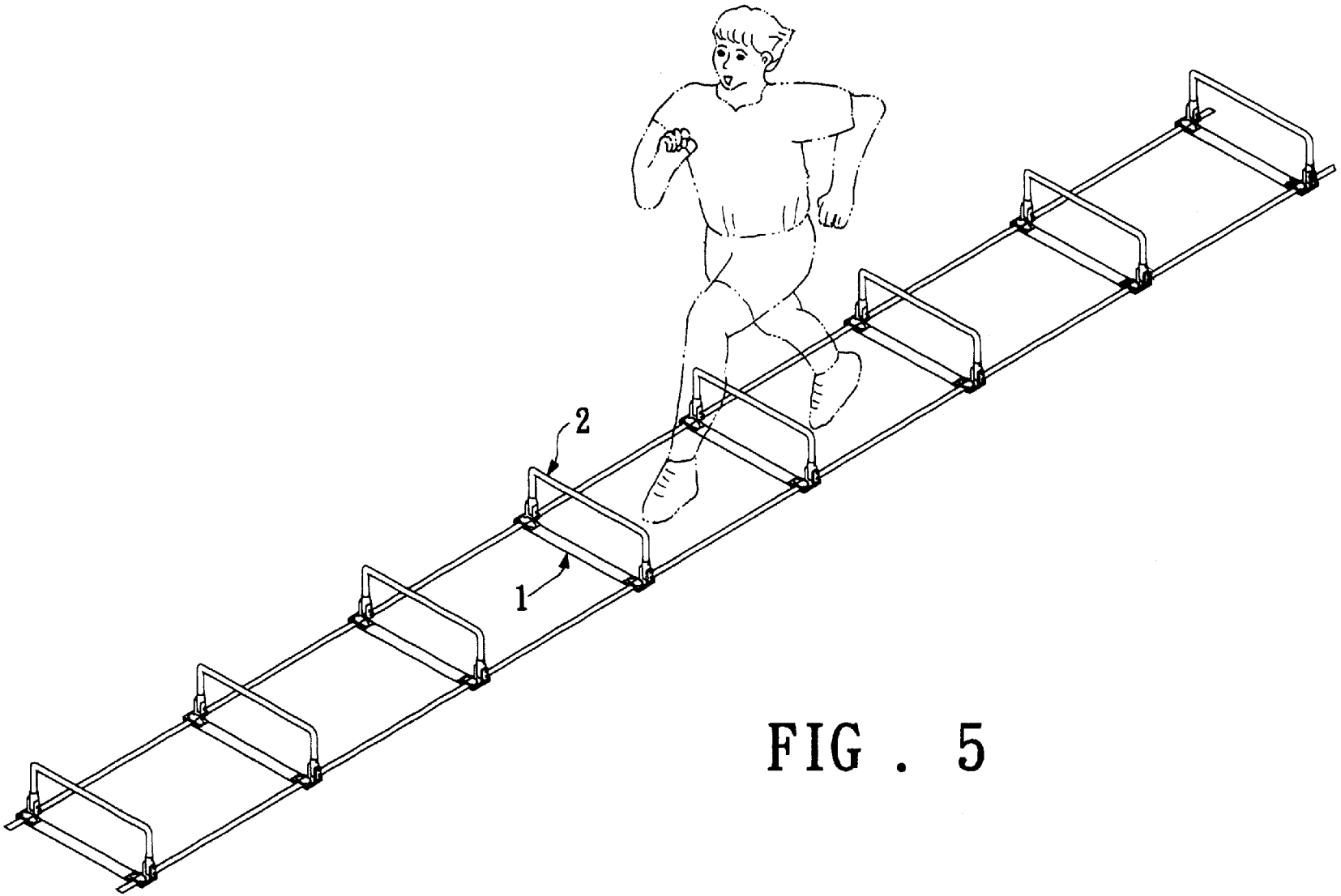
FIG. 5 is a schematic view showing the utilization of the present invention.
Figure 6:
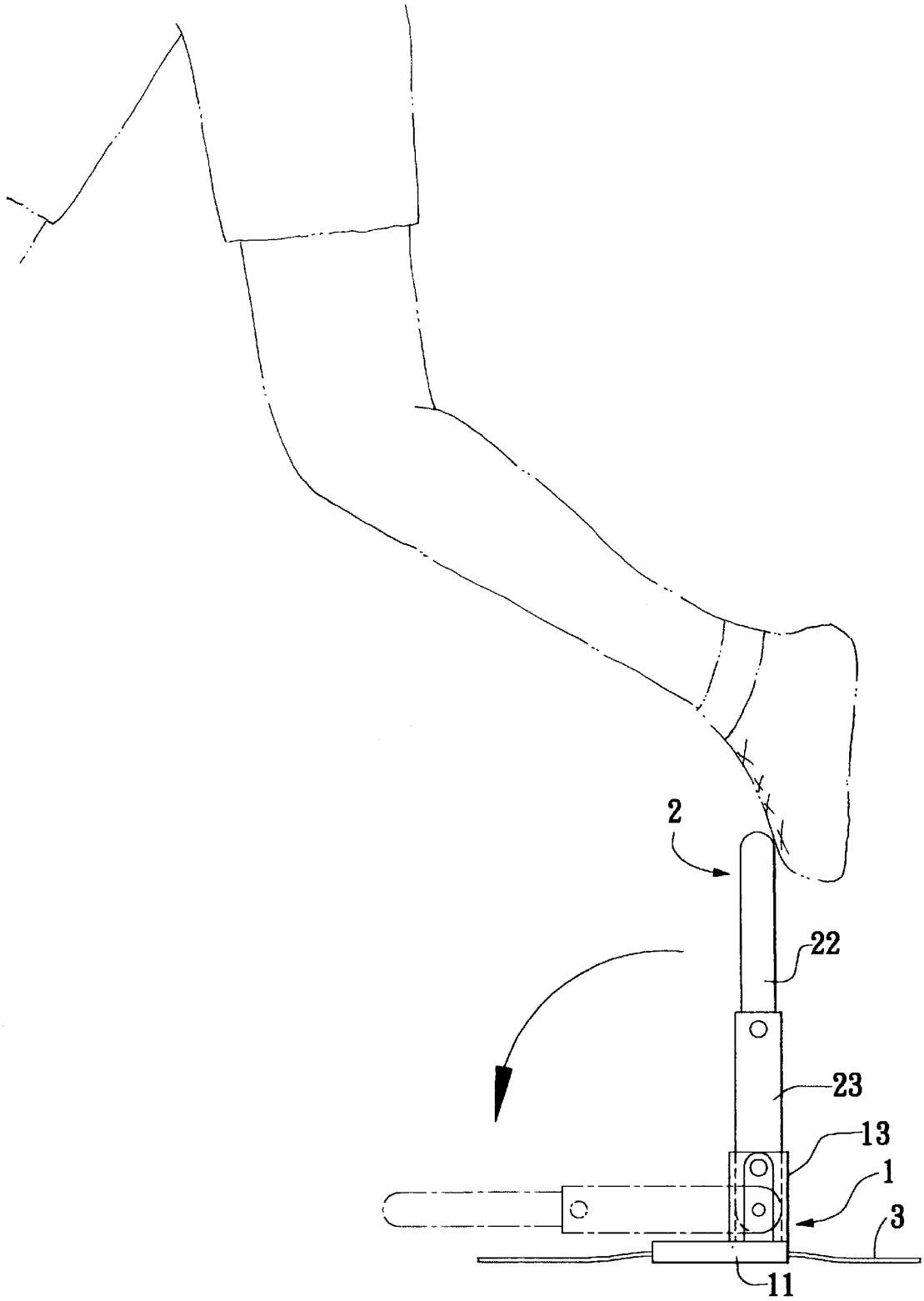
FIG. 6 is a schematic view showing that in the present invention, a grid falls down as it is collided.
Figure 7:
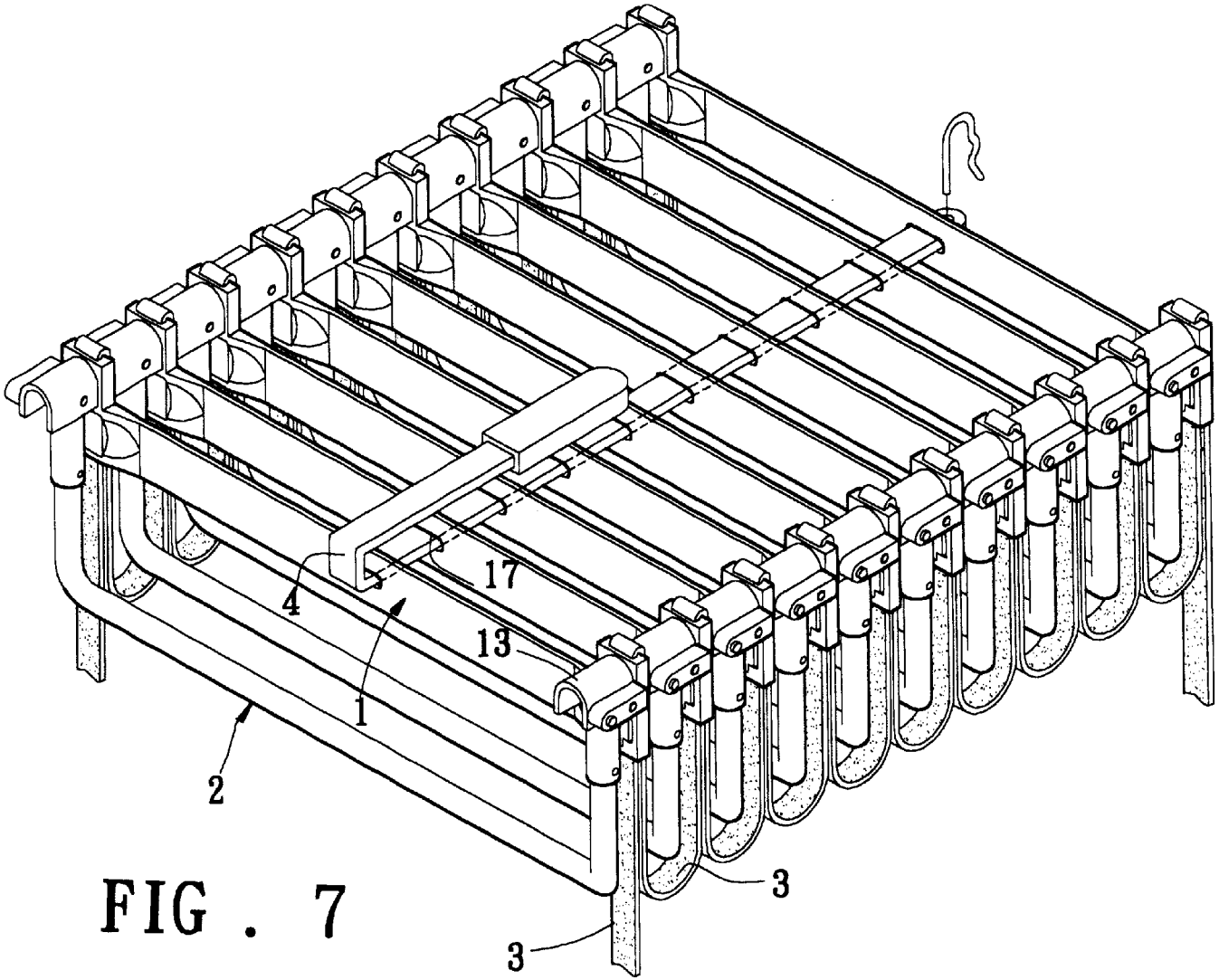
FIG. 7 is a schematic view showing the present invention being stacked for storing.

With reference to FIG. 5, the adjustable grid of the present invention is mainly used to train the basic actions of sport contestants. In general, a plurality of bases 1 are arranged between two ropes 3. The distance of two bases 1 is adjusted as requirement so as to train the distance of two steps of the contestants. If the distance is desired to be adjusted, the block 12 is taken out so that the block 12 will not clamp the rope 3. Then the base 1 is movable between the two ropes 3 having two fixing ends. After adjustment, the block 12 is pressed so that the block 12 clamps the rope 3 to fix the position of the base 1. After installation, each base 1 is interacted by the two ropes 3 and thus is stable. The. grid 2 on each base 1 is pivotally rotated to be upright. The positioning steel ball 14 on each pivotal seat 13 is embedded into the positioning hole 232 of the stand tube 23 to resist against and position the stand tube 23. Therefore, the grid 2 is upright. Furthermore, the elevation of the grid 2 is adjustable according to the requirement of the user so as to train the elevation of each jump of the contestant. Since the stand tube 23 has two buckling holes 231 thereon for engaging the buckles 24, in use, the buckle 24 can be engaged to the buckle holes 231 of different elevations and thus, the height of the grid 2 is adjustable. Therefore, in training, as a grid 2 is collided, the collision force must be larger than the resisting force of the positioning steel ball 14 so that the grid 2 collided will resist against the whole grid 2 because the positioning hole 232 moves out of the positioning steel ball 14, and thus the whole grid 2 falls down, thereby, the stand tube 23 leaves from the opening 132 of the pivotal seat 13, as illustrated in FIG. 6. As a result, the contestant will not stumble over the grid 2. Besides, since the grid 2 is pivotally installed to the pivotal seat 13 of the fixing portion 11, in storing the grid 2, the grid 2 can be fallen, and then the bases 1 are overlapped, as illustrated in FIG. 7. Then, the strip 4 will wind through the penetrating hole 17 on the base 1 so as to combine all the base together, thereby, the whole volume become smaller to avoid to occupy a larger space.

In summary, the fixing portions 11 at two ends of the base 1 of the present invention can be passed through by the rope 3. By the rope 3, the base 1 can be installed steadily. Besides, the grid 2 is pivotally installed to the base 1. As the grid 2 stands uprightly, it will be positioned by the positioning steel ball 14 and thus as the grid 2 is collided, it will fall down. As a result, the effects of safety and convenience are achieved. Moreover, in each fixing portion 11, the coupling block 12 serves to fix the rope 3 so that the distance between the two bases 1 is fixed so as to train the steps of the contestants. The joint portion 22 of the grid 2 is displaceable in the stand tube 23 for adjusting the elevation of the grid 2 so as to train the jump height of the contestant so as to be adjustable for the requirements of users.

Figure 8:
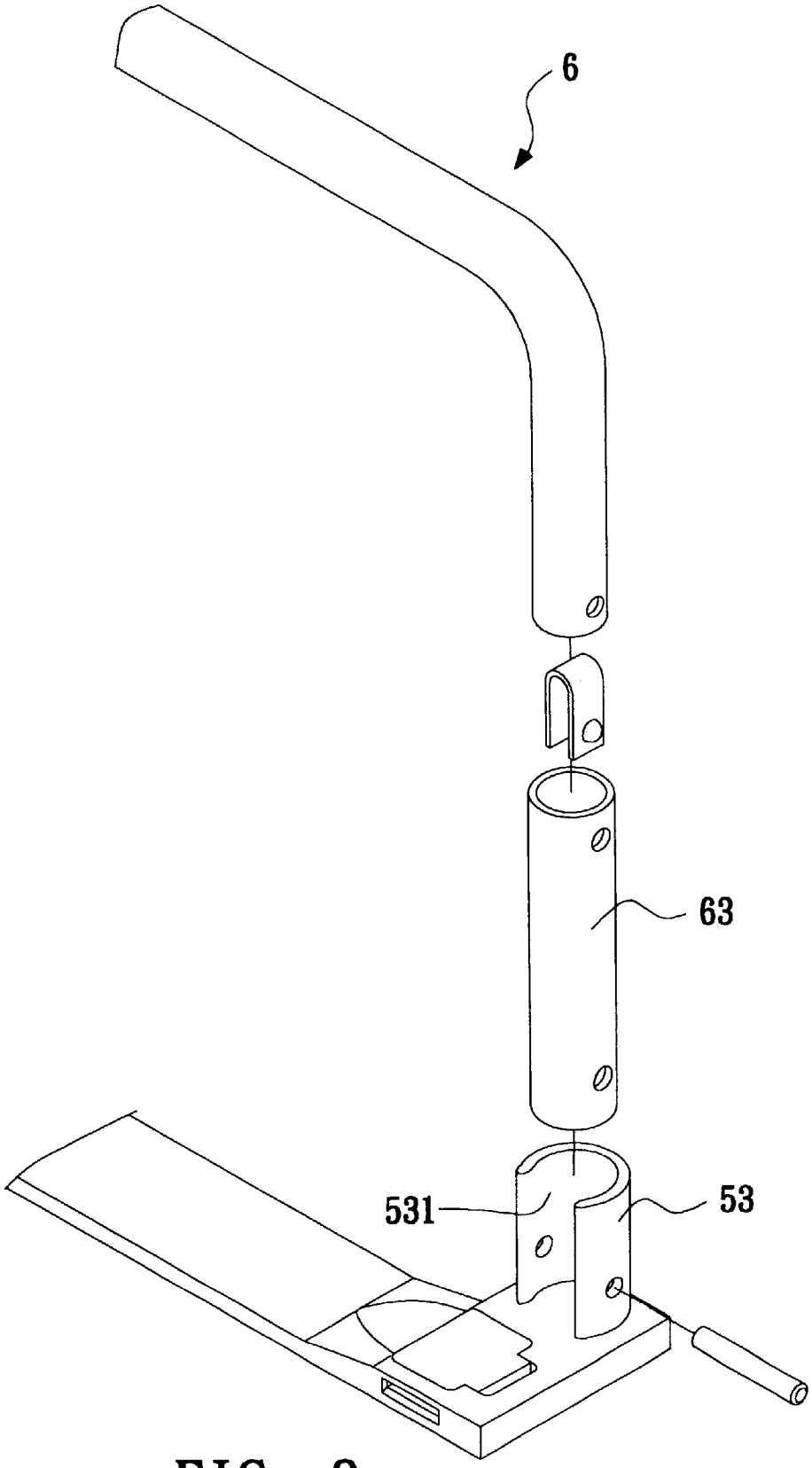
FIG. 8 is a exploded perspective view of the second embodiment in the present invention.
Figure 9A:
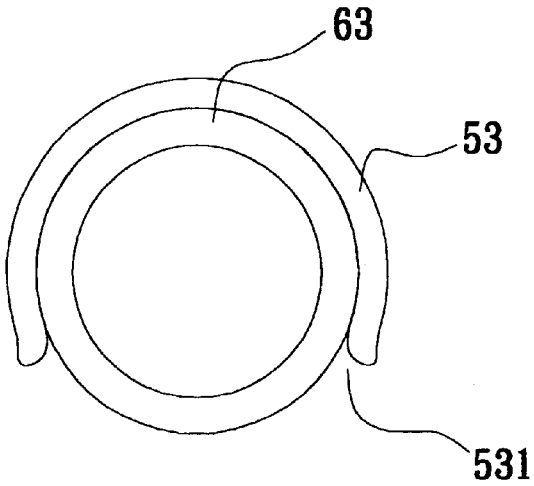
FIG. 9A is a schematic view showing the buckling of the stand tube with the pivotal seat in the second embodiment of embodiment.
Figure 9B:
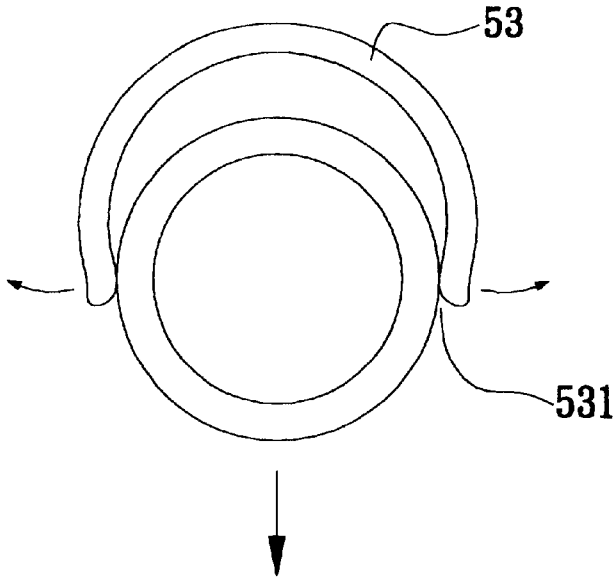
FIG. 9B is a schematic view showing the buckling of the stand tube with the pivotal seat in the second embodiment of embodiment.

With reference to FIGS. 8 and 9B, the second embodiment of the present invention is illustrated. The pivotal portion 53 is an elastic tubular body. The pivotal portion 53 has an opening 531 and positioned with respect to the position of the stand tube 63. The width of the opening 531 is slightly smaller than the outer diameter of the stand tube 63. Thereby, in an upright condition, the stand tube 63 will not be enclosed by the pivotal portion 53 and can retain the uptight condition. Referring to FIG. 9A, since the opening 531 of the pivotal portion 53 has a proper elastic effect for expanding outwards. After the grid 6 is collided, the colliding force will cause the stand tube 63 to rotate pivotally and thus fall down, and the opening 531 of the pivotal portion 53 will be expanded slightly, as illustrated in FIG. 9. Thereby, the stand tube 63 separates from the pivotal portion 53 to cause the grid 2 to fall down. Therefore, the same effect as the first embodiment is achieved.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adjustable grid, comprising a base of a predetermined width, the base having two ends each with a respective fixing portion, each fixing portion having a coupling device for fixing a rope; a pivotal scat coupled to each of the fixing portions of the base; a grid having opposing ends respectively pivotally coupled to the pivotal seats; each pivotal seat having a positioning steel ball; each end of having a positioning hole disposed in correspondence with a respective positioning steel ball when the grid is disposed in an upright position, thereby each positioning steel ball extending into the positioning hole of a respective grid end for positioning the grid upright; each of the pivotal seats has an opening at a predetermined position with respect to a pivotal rotation direction of the grid, wherein the ends of the grid respectively pass through the openings of the pivotal seats.

2. The adjustable grid as claimed in claim 1, wherein each fixing portion has a through hole for being passed through by the rope.

3. The adjustable grid as claimed in claim 1, wherein each grid has a body, the body having two ends each being bent to form a respective joint portion; each joint portion having an engaging portion with a buckle; the engaging portion of each joint portion being coupled to a respective stand tube having a buckle hole formed therein for coupling to a corresponding buckle.

* * * * *